US010549210B2

(12) United States Patent
Massey

(10) Patent No.: US 10,549,210 B2
(45) Date of Patent: Feb. 4, 2020

(54) UNIVERSAL INTERCONNECTING BUILDING BLOCK

(71) Applicant: Kurt Massey, Mooresville, NC (US)

(72) Inventor: Kurt Massey, Mooresville, NC (US)

( * ) Notice: Subject to any disclaimer, the term of this patent is extended or adjusted under 35 U.S.C. 154(b) by 0 days.

(21) Appl. No.: 16/238,827

(22) Filed: Jan. 3, 2019

(65) Prior Publication Data

US 2019/0201805 A1 Jul. 4, 2019

Related U.S. Application Data

(60) Provisional application No. 62/613,724, filed on Jan. 4, 2018.

(51) Int. Cl.
*A63H 33/04* (2006.01)
*A63H 33/08* (2006.01)
*A63H 33/06* (2006.01)

(52) U.S. Cl.
CPC ..... *A63H 33/082* (2013.01); *A63H 33/084* (2013.01); *A63H 33/086* (2013.01)

(58) Field of Classification Search
CPC ..... A63H 33/00; A63H 33/04; A63H 33/06; A63H 33/046; A63H 33/065; A63H 33/086; A63H 33/084; A63H 33/088; A63H 33/108; A63H 33/101
USPC ..... 446/85, 93, 97, 106, 108, 116, 117, 118, 446/120–122, 124
See application file for complete search history.

(56) References Cited

U.S. PATENT DOCUMENTS 4,305,221 A * 12/1981 Chatani ..... A63H 33/04 446/121
5,000,713 A * 3/1991 Cheng ..... A63H 33/06 273/160
6,648,714 B1 * 11/2003 Kuo ..... A63H 33/065 446/120
7,517,270 B2 * 4/2009 Marzetta ..... A63H 33/101 446/113
8,366,507 B2 * 2/2013 Chen ..... A63H 33/086 446/108
8,850,683 B2 * 10/2014 Haughey ..... A63H 33/046 29/428

* cited by examiner

*Primary Examiner* — Kien T Nguyen
(74) *Attorney, Agent, or Firm* — Alloy Patent Law; Walker Griffin Weitzel

(57) ABSTRACT

The inventor of the present invention aimed to solve the problem of limited modes of interconnection between blocks. To solve this problem, the inventor created a building block that is reconfigurable to connect to a neighboring block by any two adjacent faces. To achieve this, the inventor created a system that allows a user to construct and reconfigure each individual face to provide either male or female connecting features, as well as configurable slidable connection between male and female parts. Said slidable connection allows two mating faces to be shifted or offset from one another in continuously varying amounts of offset.

8 Claims, 22 Drawing Sheets

Fig. 8
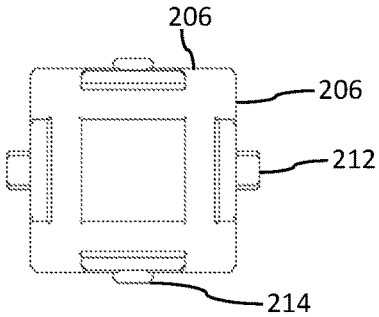
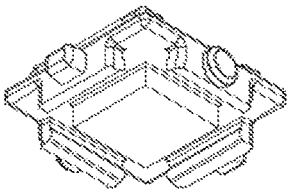
Fig. 11
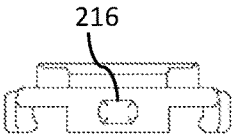
Fig. 9
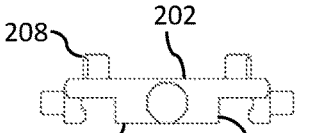
Fig. 6
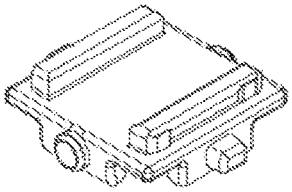
Fig. 10
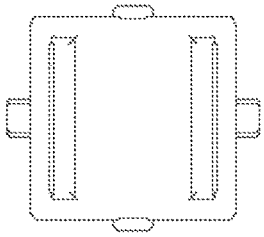
Fig. 7

Fig. 24
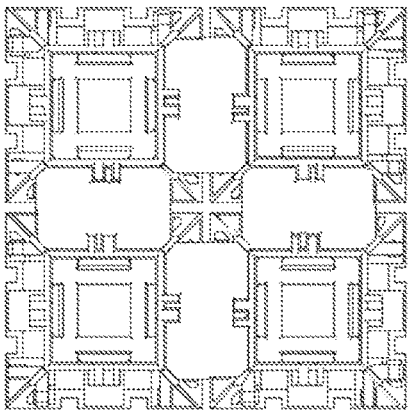
Fig. 23
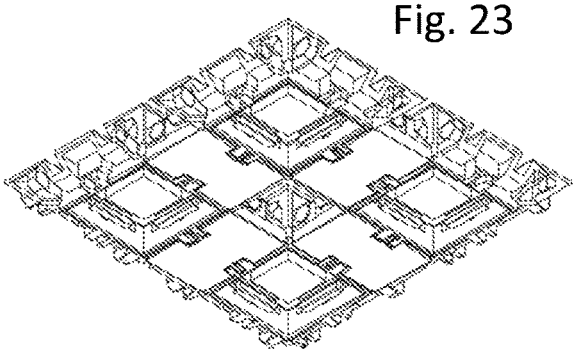
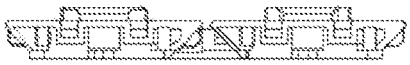
Fig. 19
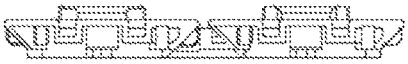
Fig. 22
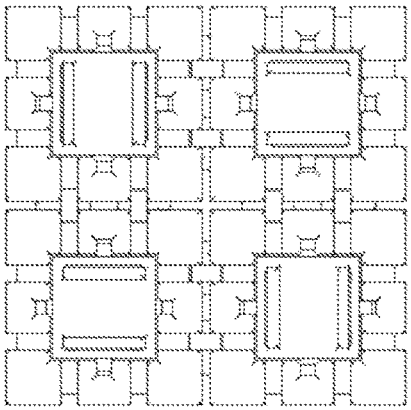
Fig. 20
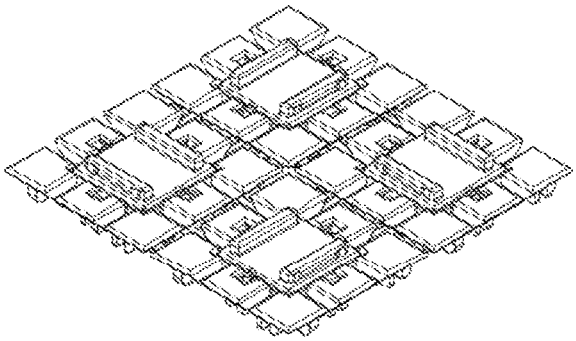
Fig. 21

A (2:1)
Fig. 28
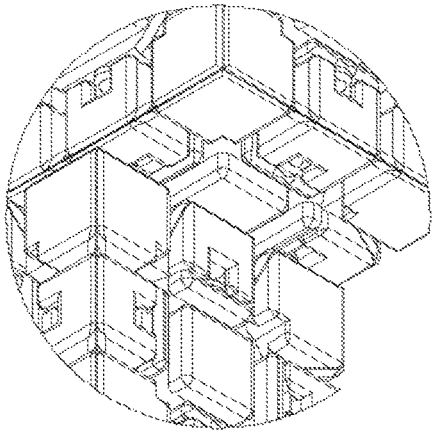
Fig. 29
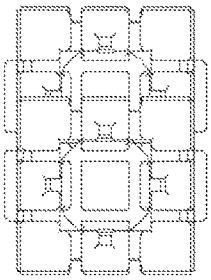
Fig. 27
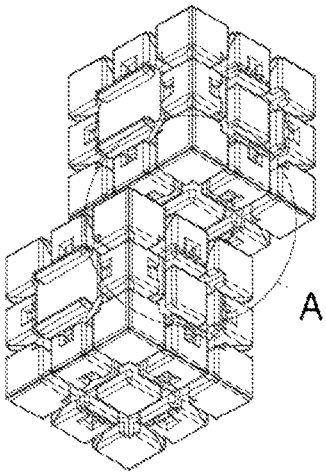
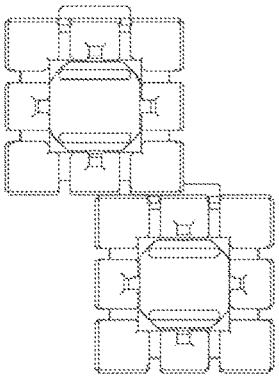
Fig. 30
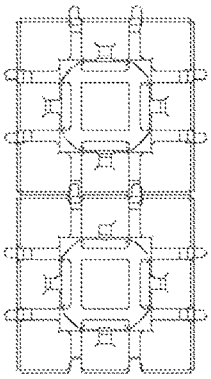
Fig. 31
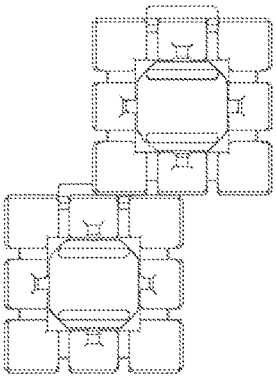
Fig. 32

Fig. 33
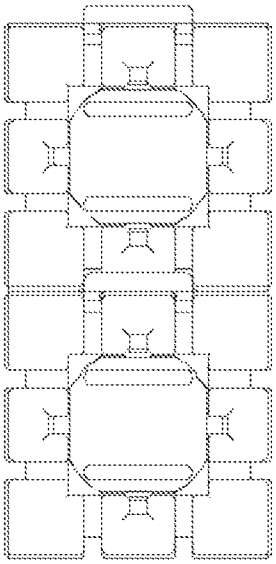
Fig. 34
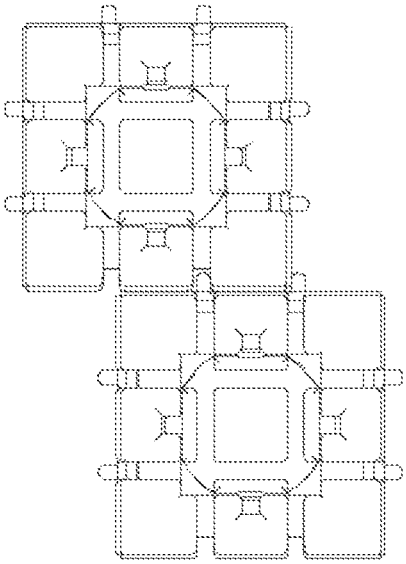
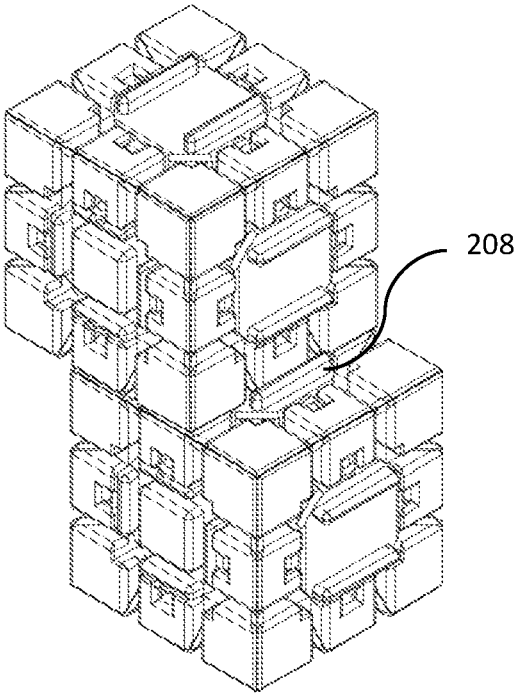
Fig. 35
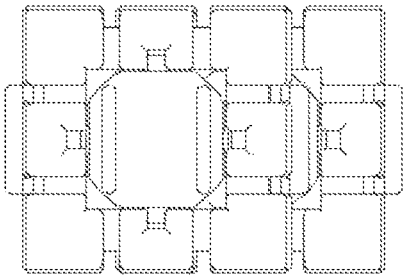
Fig. 36

Fig. 38
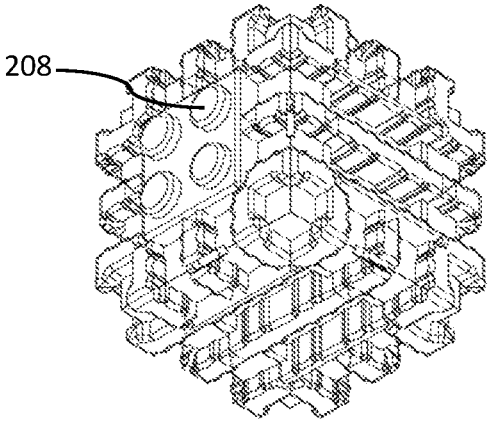
Fig. 37
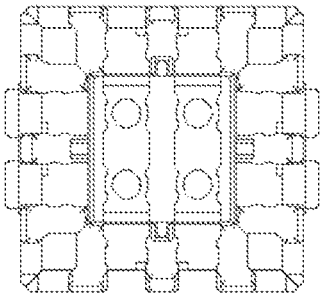
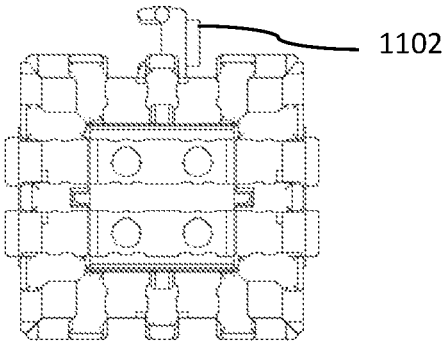
Fig. 39
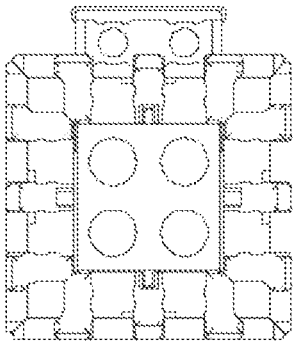
Fig. 40

Fig. 41
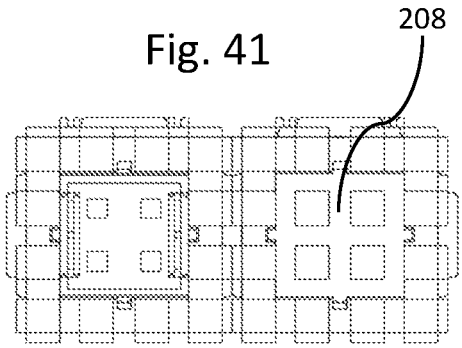
Fig. 42
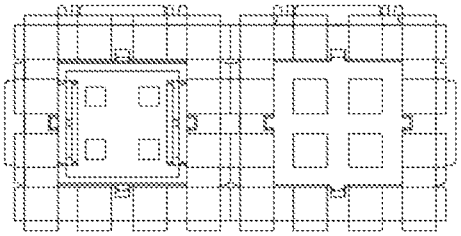
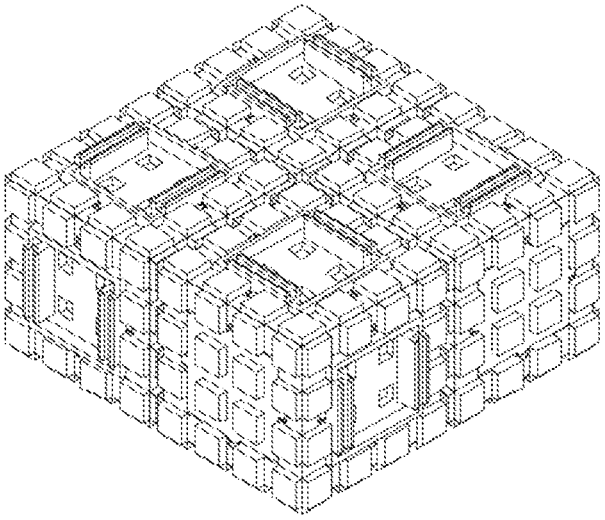
Fig. 43
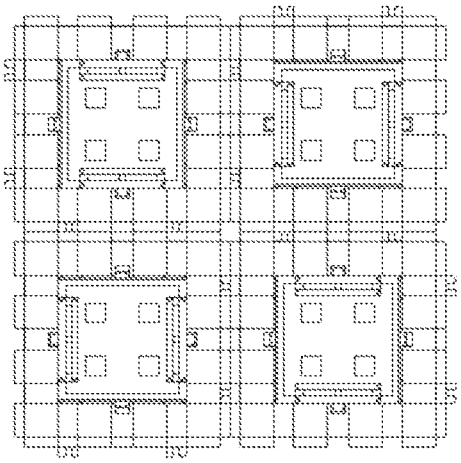
Fig. 44

Fig. 46
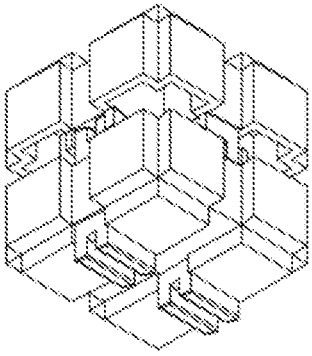
Fig. 45
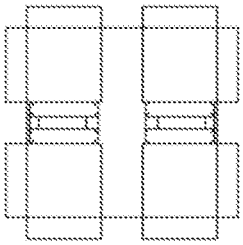
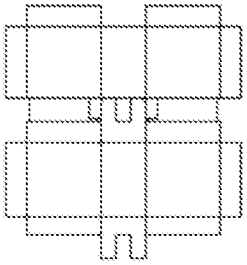
Fig. 47
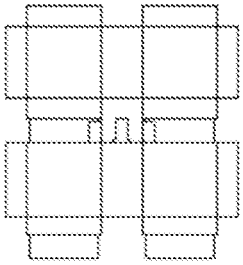
Fig. 48
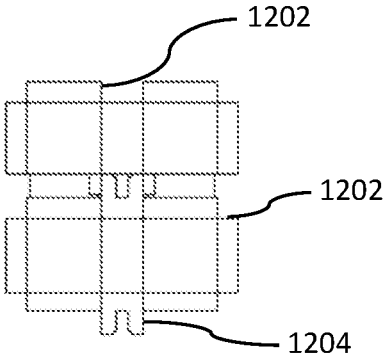
Fig. 49

Fig. 51
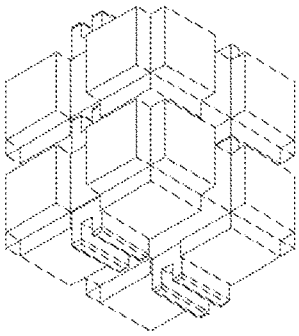
Fig. 50
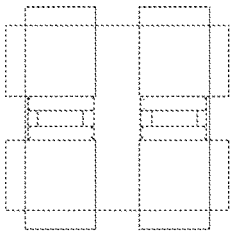
Fig. 52
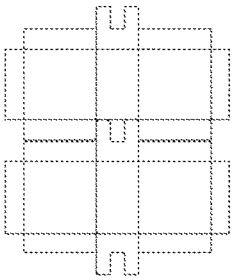
Fig. 53
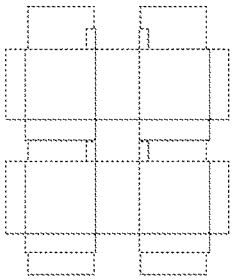
Fig. 54
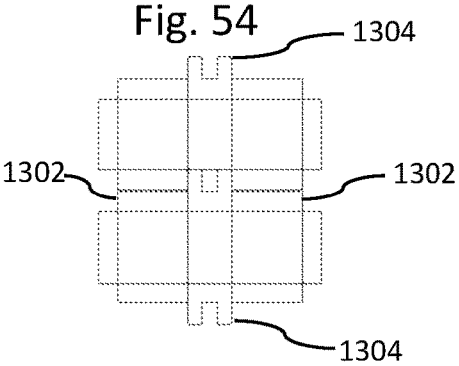
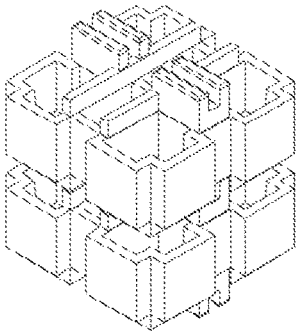
Fig. 55
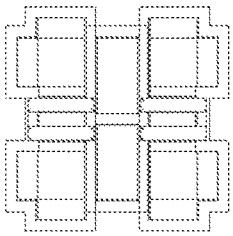
Fig. 56

Fig. 57
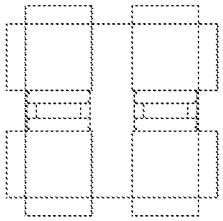
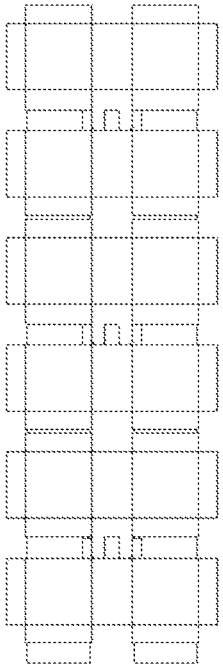
Fig. 58
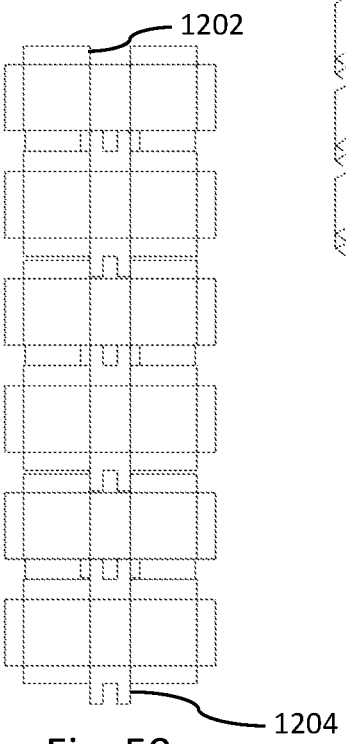
Fig. 59
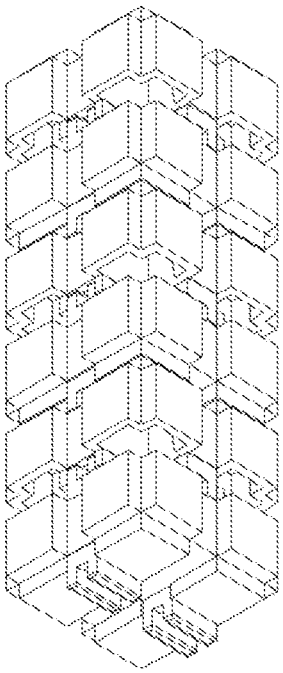
Fig. 60

Fig. 61
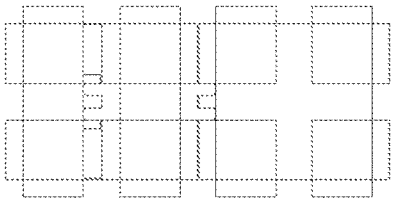
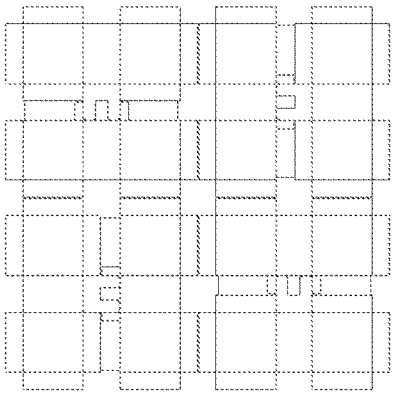
Fig. 63
Fig. 62
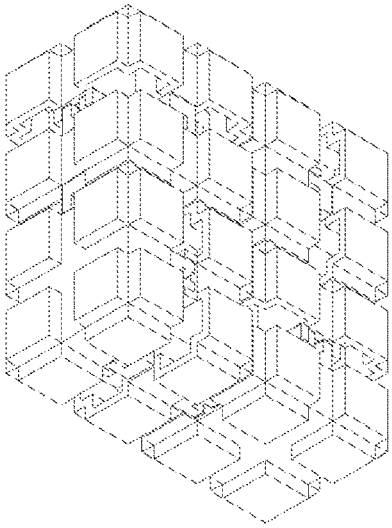
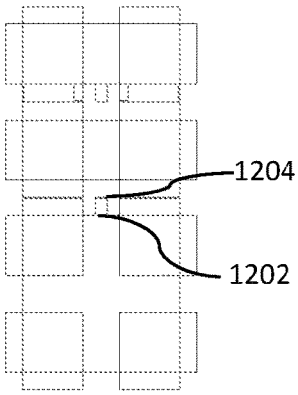
Fig. 64

Fig. 65
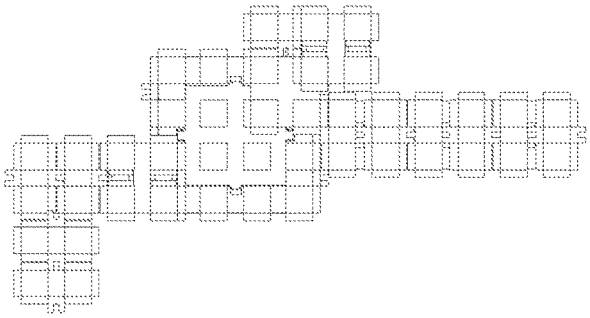
Fig. 66
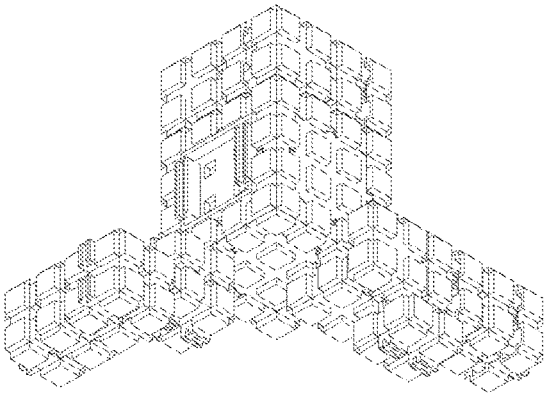
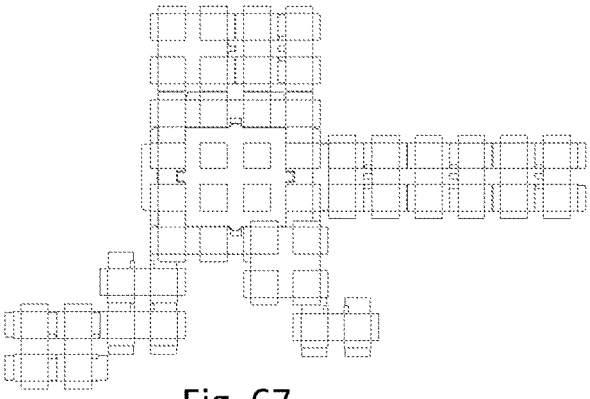
Fig. 67
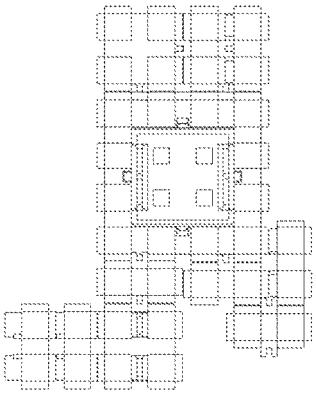
Fig. 68

Fig. 69
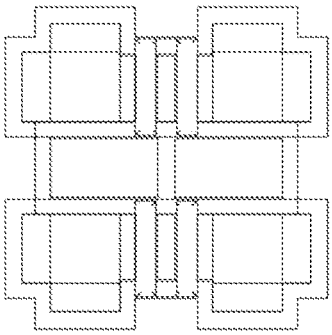
Fig. 70
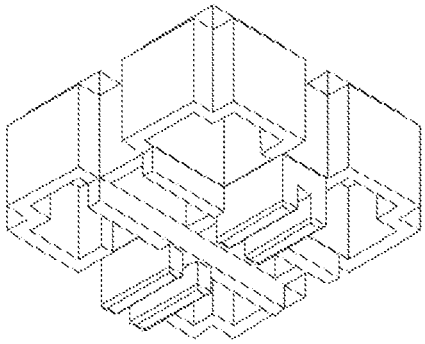
Fig. 71
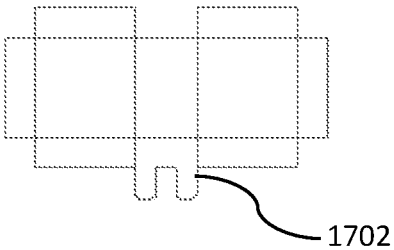
Fig. 72
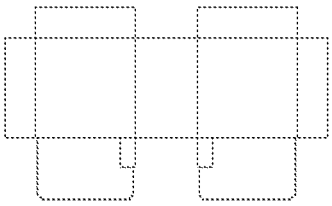
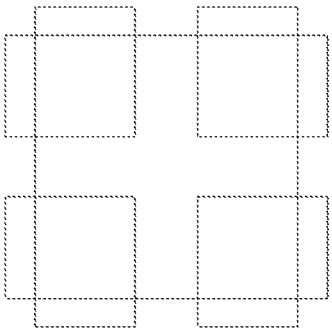
Fig. 73
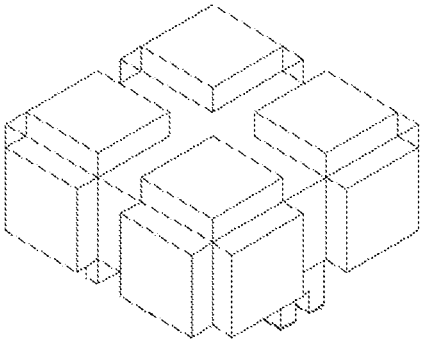
Fig. 74

Fig. 75
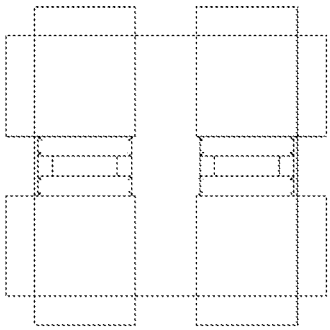
Fig. 76
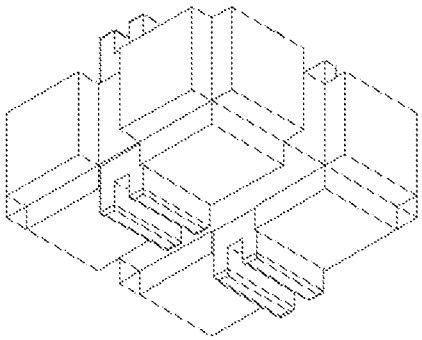
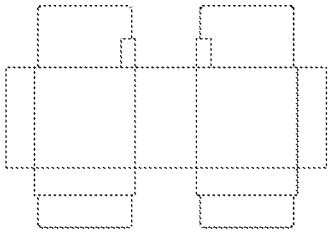
Fig. 77
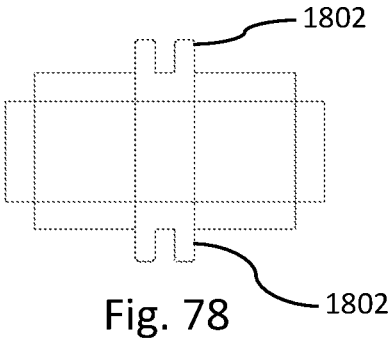
Fig. 78
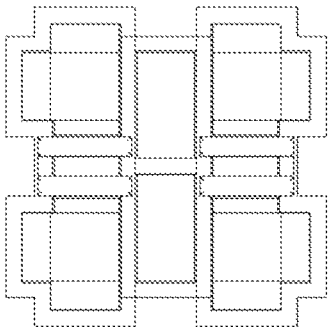
Fig. 79

UNIVERSAL INTERCONNECTING BUILDING BLOCK

CROSS-REFERENCE TO RELATED APPLICATIONS

This application claims priority to U.S. Provisional Application No. 62/613,724 filed Jan. 4, 2018. The content of the above application is incorporated by reference in its entirety. This disclosure, including written description and associated figures are identical in content to the referenced application.

FIELD OF THE DISCLOSURE

The overall field of invention is interconnecting building blocks.

BACKGROUND

This invention relates generally to interconnecting building blocks that are connectible using only integral block features, and more specifically to a system of several types of interconnecting blocks that are adaptable and reconfigurable in order to allow flexible interconnection between multiple blocks.

Interconnecting blocks are well known in the toy industry. Lego and Mega Bloks provide two such examples of toy building blocks having integral features that provide for ready interconnection between blocks. A variety of interconnecting blocks are commercially available, and the majority of such blocks operate on the principal that a first block will have a projecting male feature, a second block will have a female feature, and the male feature of the first block will mate to the female feature of the second block to create a semi-permanent mechanical connection between the two. Generally, the mechanical connection will lock the blocks into relative positions with one another, and the blocks cannot be rearranged or re-oriented with respect to one-another without fully disconnecting the blocks and then reconnecting in the new desired configuration.

The basic form of this type of block generally provides male features on the top surface of a block and female features on the bottom surface of the block. The interconnection between male and female blocks is generally quantized, such that two given blocks are connectible in a finite number of configurations.

This general design concept has significant implications to the types of structures that can be constructed of these blocks. For example, if a regular rectangular vertical wall is built of basic Lego-type bricks, any bricks not at the periphery of the wall are fully locked into place and cannot be moved or removed without some degree of disassembly of the entire wall. Furthermore, a wall constructed in such a manner will not have interconnecting features on any faces other than the top and bottom faces. Therefore, it would not be possible to further interconnect additional blocks to the existing wall in any areas other than the top or bottom.

Specialized interconnecting blocks exist that have multiple faces with male or female interconnection features, but they are not the norm. Typically, significant planning is required to construct a desired structure out of interconnecting toy blocks because of the limited ways in which they can be connected and because of the difficulty of modifying a structure on an ad hoc basis.

In general, interconnecting building blocks are not reconfigurable, and a given block can only be connected to other blocks in the manners permitted by the existing permanent interconnection feature arrangement. If a given block is not suitable for a given situation or use, then a different, suitable block must be procured.

A need exists for an interconnecting block and interconnecting block system that will allow users to connect blocks in a much more flexible and unconstrained manner.

SUMMARY

The disclosure presented herein relates to a universally interconnecting building block and related system. In some embodiments, the preceding and following embodiments and descriptions are for illustrative purposes only and are not intended to limit the scope of this disclosure. Other aspects and advantages of this disclosure will become apparent from the following detailed description.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Existing interconnecting building blocks are generally solid and generally rigid bodies. Each individual building block is manufactured with a given set of interconnection features, and a user is limited to connecting the blocks in manners that the manufactured designs permit. Additionally, the design of the interconnection features generally do not permit slidable mechanical connection between the blocks. If a user desires to modify the connection between the blocks, a user is generally required to disconnect the blocks, then reconnect in the new, desired connection.

The inventor of the present invention aimed to solve the problem of limited modes of interconnection between blocks. To solve this problem, the inventor created a building block that is reconfigurable to connect to a neighboring block by any two adjacent faces. To achieve this, the inventor created a system that allows a user to construct and reconfigure each individual face to provide either male or female connecting features, as well as configurable slidable connection between male and female parts. Said slidable connection allows two mating faces to be shifted or offset from one another in continuously varying amounts of offset.

The universal blocks are comprised of just three fundamental parts: 1) a slide block, 2) a slide face, and 3) flat connectors. These three parts allow users to construct infinitely configurable and infinitely interconnecting cubic blocks.

A basic cubic block is formed by combining six square faces, each face formed by a slide block and a slide face. The basic cubic block is referred to by the inventor as a "Byte."

The system of universal blocks is further comprised of an additional family of blocks, "Bits", which are half the size of a Byte in linear dimensions, and therefore one eighth of the volume of a Byte. Bits are flexibly interconnectable with both other Bits as well as Bytes. Bits, too, are reconfigurable, but because of Bits' smaller size, reconfiguration is limited to certain faces. Bits' smaller size further expand the flexibility of the system and provide users additional options easily construct large assemblies.

The Bit family of blocks is fundamentally cubic, while variations on the cubes provide differing combinations and orientations of male and female faces to accommodate interconnection as needed.

Finally, interconnection is highly flexible between the blocks, in that blocks may be aligned in multiple quantized positions in certain directions and slidably interconnected in other positions, which provides much higher degrees of flexibility in assembly design and construction.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

FIGS. 6-11 show various rotated views of an embodiment of a slide face.

FIGS. 19-24 show various rotated views of an assembly of slide blocks, slide faces, and flat connectors assembled to make a portion of planar assembly.

FIGS. 27-32 show various rotated and detail views of a pair of Bytes assembled in a slidably offset configuration.

FIGS. 33-36 show various rotated views of a pair of Bytes assembled in a quantized offset configuration.

FIGS. 37-40 show various rotated views of an alternative embodiment of a Byte.

FIGS. 41-44 show various rotated views of an assembly of four Bytes assembled in an aligned configuration.

FIGS. 45-49 show various rotated views of an embodiment of a Female Bit.

FIG. 50-56 shows various rotated views of an embodiment of a Male Bit.

FIGS. 57-60 show various rotated views of an assembly of Bits.

FIGS. 61-64 shows various rotated views of an assembly of Bits.

FIGS. 65-68 show various rotated views of an assembly of a Byte and multiple Bits.

FIGS. 69-74 shows various rotated views of an X Half-Bit.

FIGS. 75-79 show various rotated views of a Y Half-Bit.

DETAILED DESCRIPTION

Figure 4:
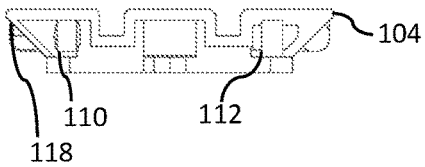
FIGS. 1-5 show various rotated views of an embodiment of a slide block.
Figure 5:
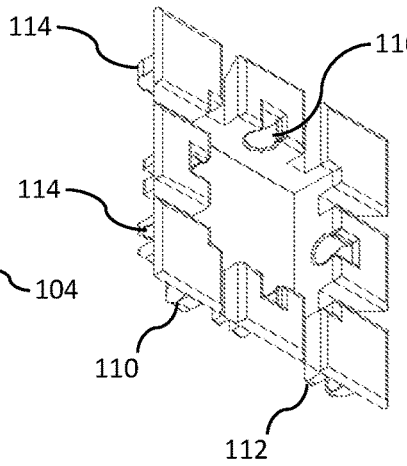
Figure 3:
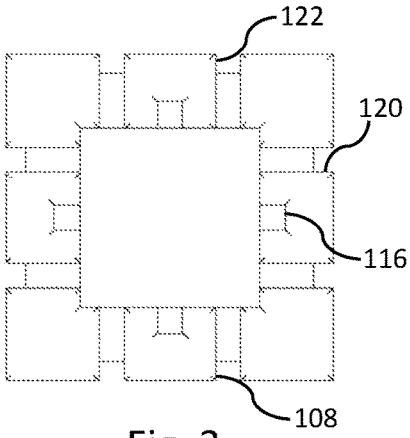
Figure 1:
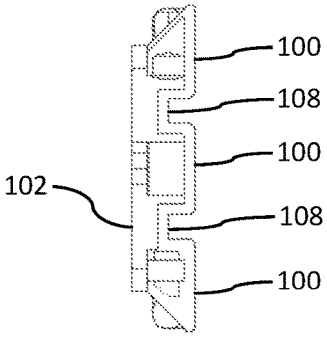
Figure 2:
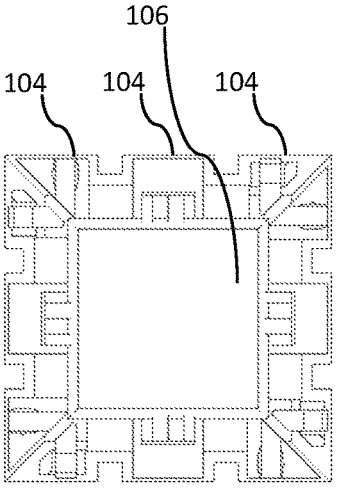
Figure 15:
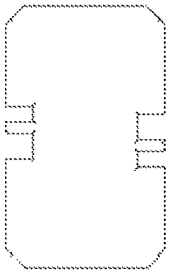
FIGS. 12-17 show various rotated views of an embodiment of a flat connector.
Figure 17:
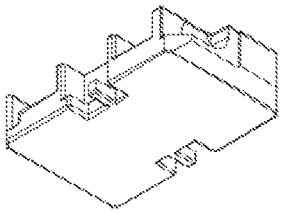
Figure 12:
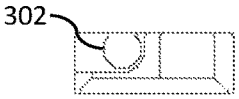

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

FIGS. 1-5 show various rotated views of an embodiment of a slide block. Slide blocks are one of the fundamental elements of the system. A slide block is generally square and planar in shape, such that it has an outer face 100, an inner face 102, and four edges 104. The slide block is further characterized as having a large center hole 106 adapted to accept the slide face.

Slide blocks incorporate a variety of interconnection features. The outer face incorporates a plurality of channels 108 that run parallel to the edges 104. These channels 108 function as a female interconnection feature for mating the block to the male features of slide faces or Bits. These channels can be further categorized as being either "horizontal" 120 or "vertical" 122.

The edges of the slide block each incorporate a pair of edge interconnection features 114, comprising of a male interconnection tab feature 110, and a female interconnection tab feature 112. A pair of edge interconnection features 114 on an edge 104 can be mated to an edge interconnection feature pair 114 on another slide block. The edges 104 of the slide blocks incorporate a miter feature 118. When a slide block is interconnected directly with one another using the edge interconnection features 114, the miter feature 118 and the orientation of the tabs cause the slide blocks to mate at a right angle.

The large center hole 106 incorporates a female slide face connection feature 116 on each edge of the hole 106. The female slide face connection features 116 accept a male slide face connection feature.

Each of the mating features are adapted to form semi-permanent connections between mated parts, such that parts may be assembled or mated together by hand, have some degree of mechanical strength once mated, and may be disassembled readily by hand. The strength of the mechanical attachment between parts is dependent on the precise shape and tolerances of the mated pairs, and mechanical strength may be modified accordingly.

In the shown embodiment, the slide block has two channels 108 running in each direction. In alternative embodiments, a slide block may have three or more channels running in each direction in order to allow a greater number of quantized offset configurations.

FIGS. 6-11 show various rotated views of an embodiment of a slide face. A slide face is adapted to fit in the hole 106 in the slide block. The slide face is characterized as being generally planar in shape, with a male face 202, a female face 204, and four edges 206. The male face 202 has a plurality of male interconnection features 208 that are adapted to mate to the slide block female interconnection features 116 or with the slide face female interconnection feature 210. The slide face has two female interconnection features 210 running in each direction.

Slide face edges each have two pairs of interconnection features. A pair of male edge connectors 212 mate to the female feature 116 on the slide block hole 106. An additional pair of male edge stabilizing connectors 214 serve to align the slide face to be coplanar with the slide block. The stabilizing connectors 214 will mate with the female features 116 on the slide block, but their length is reduced such that the slide face can be flipped along the axis formed by male edge connectors 212 while installed within hole 106, and the stabilizing connectors 214 will merely serve to index the slide face into a position parallel to the slide block. The male edge connectors 212 are generally cylindrical, though a modified cylinder profile with flats 216 can reduce the force required to install a slide face in a slide block during assembly. The male edge connectors 212 may be connected to either pair of female features 116 on a given slide block, such that a slide block can be rotated within the plane of the slide block by 90 degrees in the hole 106. This permitted rotation provides that a slide face may be installed in a slide block in three general configurations: 1) with male features 208 oriented outward and parallel to horizontal channels 120, 2) with male features 208 oriented outward and parallel to vertical channels 122, and 3) with female features 210 oriented outward.

In the shown embodiment, the slide face has two male connection features 208 and four female interconnection features 210. In alternative embodiments, a slide block may have three or more connection features running in each direction in order to allow a greater number of quantized offset configurations.

FIGS. 12-17 show various rotated views of an embodiment of a flat connector. A flat connector is used to connect a pair of slide blocks in an adjacent coplanar configuration. The flat connector therefore has interconnection tab features 302 functionally identical to the edge interconnection features 114 on the slide blocks. Similarly, it has mitered receivers 304 designed to accept the miter features 118 of the slide blocks, however the miter feature of the flat connector is configured to connect and align adjacent slide blocks in a plane.

Figure 18:
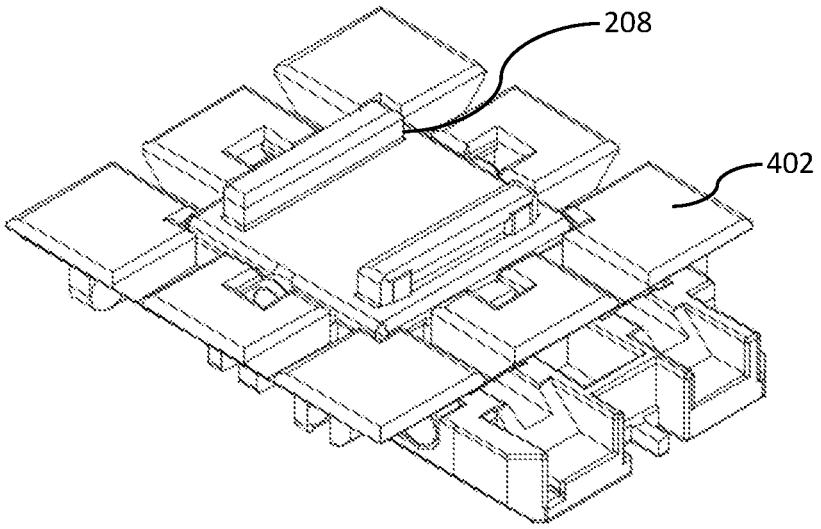
FIG. 18 shows a perspective view of an assembly of a slide block, slide face, and flat connector.

FIG. 18 shows a perspective view of an assembly of a slide block, slide face, and flat connector. In the shown assembly, the male interconnection features 208 of the slide face are oriented toward the outer face of the slide block 402.

Figure 14:
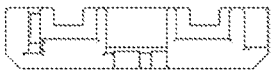
Figure 16:
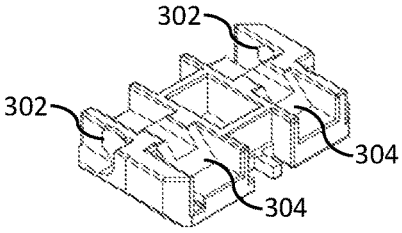
Figure 13:
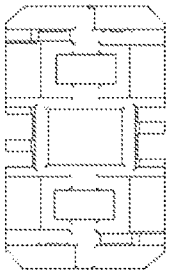

FIGS. 19-14 show various rotated views of an assembly of slide blocks, slide faces, and flat connectors assembled to make a planar assembly. In the shown assembly, multiple slide blocks are interconnected in a coplanar configuration by flat connectors. Additionally, the shown assembly represents the way in which the slide faces may be installed with the male interconnection features 208 running parallel to either pair of female features 120 or 122 of a slide block.

Figure 25:
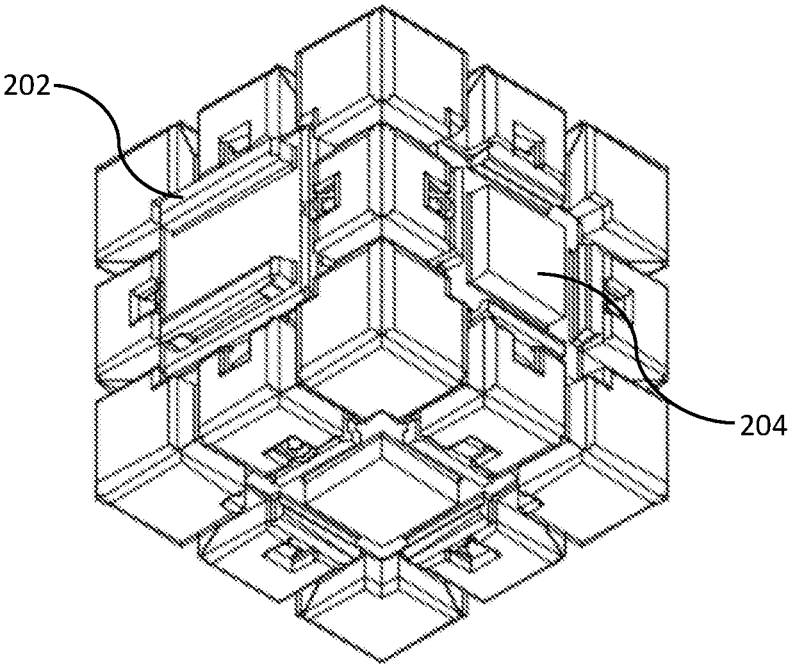
FIG. 25 shows a perspective view of an assembly of slide blocks and slide faces to make a Byte.

FIG. 25 shows a perspective view of an assembly of slide blocks and slide faces to make a Byte. In this embodiment, slide blocks are mated directly to other slide blocks using the edge interconnection features 114. Six slide blocks may be mated directly together in this manner to form a cube. Slide faces may then be installed in each slide block to form a Byte. The slide faces may be installed with such that either the male 202 or female 204 faces are oriented outward. Similarly, users may choose the orientation of the male faces 202 such that the male connection features 208 can run parallel to either pair of female features 120 or 122.

Figure 26:
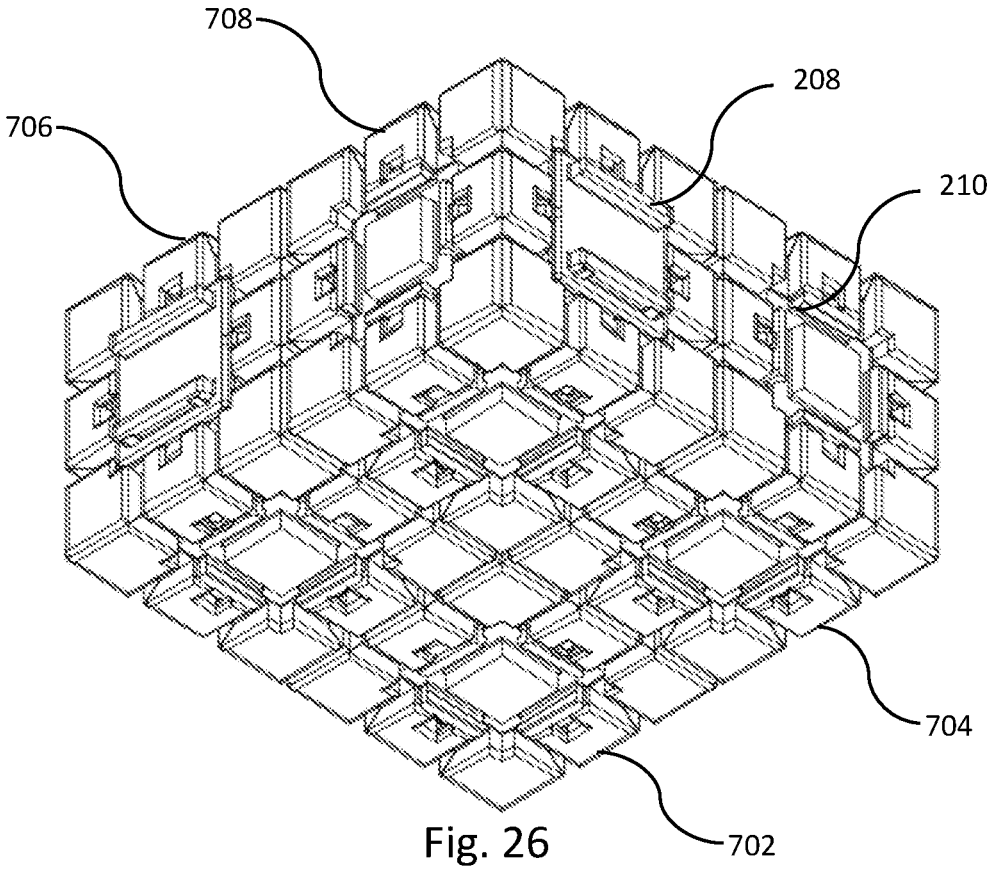
FIG. 26 shows a perspective view of an assembly of four Bytes.

FIG. 26 shows a perspective view of an assembly of four Bytes. The four Bytes, 702, 704, 706, and 708 are interconnected by mating the male interconnection feature 208 on a slide face to a female interconnection feature 210 of the adjacent block.

FIGS. 27-32 show various rotated and detail views of a pair of Bytes assembled in a slidably offset configuration. In this embodiment, the male interconnection feature 208 is mated to the female interconnection feature 108 of the slide face. The two Bytes are therefore slidably connected along the axis parallel to the male features 208 and therefore the offset amount is continuously adjustable.

FIGS. 33-36 show various rotated views of a pair of Bytes assembled in a quantized offset configuration. The male interconnection feature 208 is further capable of mating with a slide block along any pair of adjacent parallel female mating features, including the edge of the Byte. In this manner, the Bytes may also be assembled offset from one another, however amount of offset is dictated by the position of the mating features, and is therefore quantized when offsetting in a direction perpendicular to the male features 208. In the shown configuration, only three possible such offsets are possible: offset left, no offset, and offset right. In alternative embodiments of the invention that incorporate greater numbers of mating features, greater numbers of offset arrangements would be possible.

FIGS. 37-40 show various rotated views of an alternative embodiment of a Byte. In this embodiment, the male interconnection features 208 take the form of cylindrical pegs. In the shown embodiment, the assembly is in a partially assembled state, wherein a slide face is installed in an intermediate position 1102.

FIGS. 41-44 show various rotated views of an assembly of four Bytes assembled in an aligned configuration. In this embodiment, Bytes incorporate additional female 108 features to provide greater possibility for quantized offset assembly. Furthermore, the greater number of connection features may also improve the mechanical interconnection between the Bytes.

FIGS. 45-49 show various rotated views of an embodiment of a Female Bit. Bits are generally characterized as being one half the size of Bytes in linear dimensions, and one eighth of the volume. In the embodiment, the Bit has female connecting features 1202 on five of the six sides, with a single male connecting feature 1204 on one face.

FIGS. 50-56 show various rotated views of an embodiment of a Male Bit. In the embodiment, the Bit has female connecting features 1302 on four of the six sides, with a male connecting feature 1304 on two opposing faces. Every Bit is formed of an X Half-Bit and a Y Half-Bit, however the orientation of the Half-Bits will dictate whether the Half-Bit is of the Male or Female variety.

FIGS. 57-60 show various rotated views of an assembly of Female Bits. In this embodiment, the Female Bits are connected in a repeating linear pattern by connecting the female feature 1202 to the male feature 1204 on the opposite face.

FIGS. 61-64 show various rotated views of an assembly of Bits. In this embodiment, the male feature 1204 is mated to a female feature 1202 on a side adjacent to the feature 1204.

FIGS. 65-68 show various rotated views of an assembly of a Byte and multiple Bits. This embodiment demonstrates the manifold ways in which the system of Bits and Bytes may be interconnected.

FIGS. 69-74 show various rotated views of an X Half-Bit. An X Half-Bit is characterized as having a single male interconnection feature 1702.

FIGS. 75-79 shows various rotated views of a Y Half-Bit. A Y Half-Bit is characterized as having two male interconnection features 1802.

Figure 80:
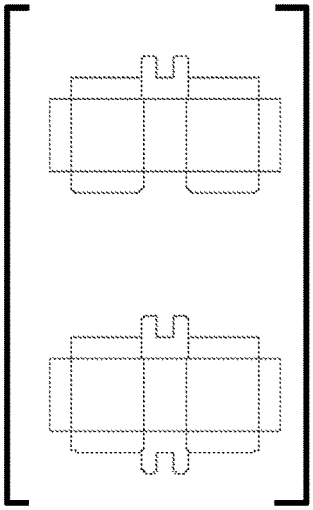
FIGS. 80-82 shows various rotated exploded views of a Male Bit.
Figure 81:
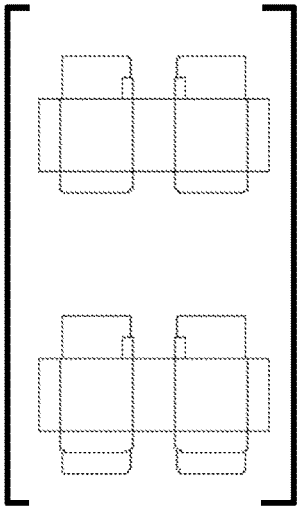
Figure 82:
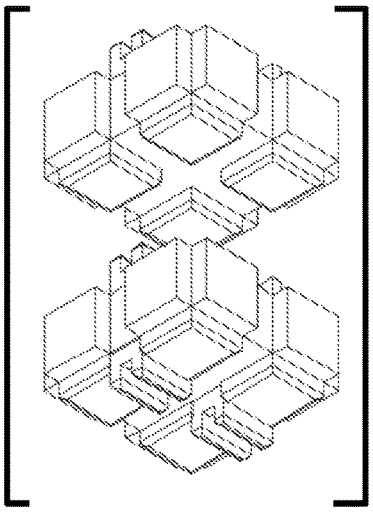

FIGS. 80-82 show various rotated exploded views of a Male Bit. The Male Bit is formed from an X Half-Bit and a Y Half-Bit mated such that the male feature 1702 of the X Half-Bit is oriented outwards.

Figure 83:
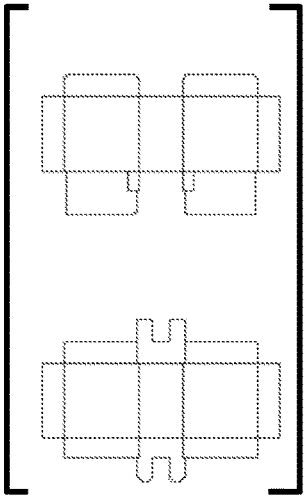
FIGS. 83-85 show various rotated exploded views of a Female Bit.
Figure 84:
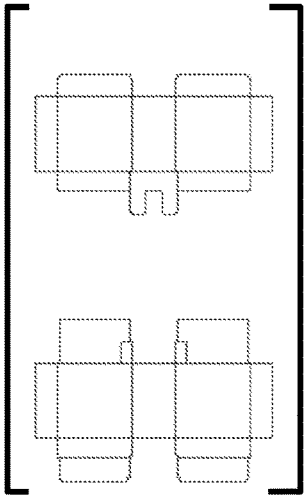
Figure 85:
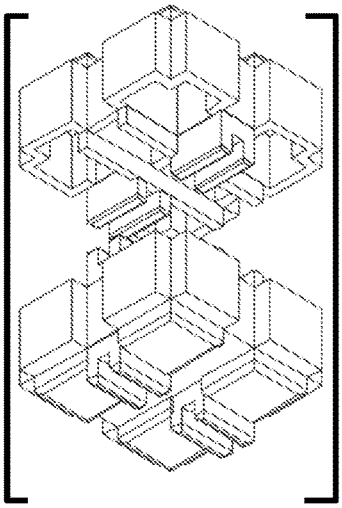

FIGS. 83-85 show various rotated exploded views of a Female Bit. The Female Bit is formed from an X Half-Bit and a Y Half-Bit mated such that the male feature 1702 of the X Half-Bit is oriented inwards and mated to a corresponding female feature on the Y Half-Bit.

Figure 86:
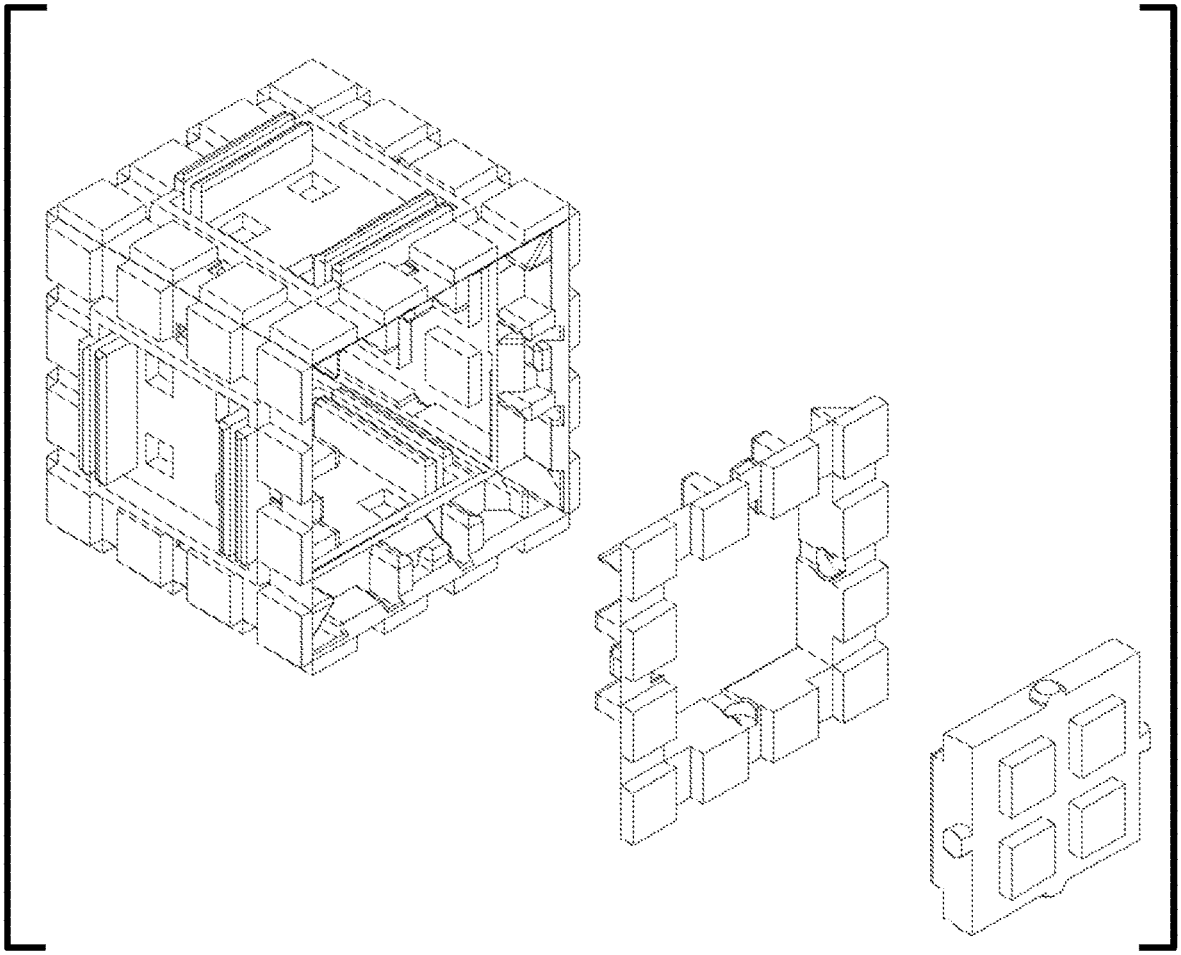
FIG. 86 shows an exploded view of a Byte in which one slide face and one slide block are shown in exploded positions.
Figure 87:
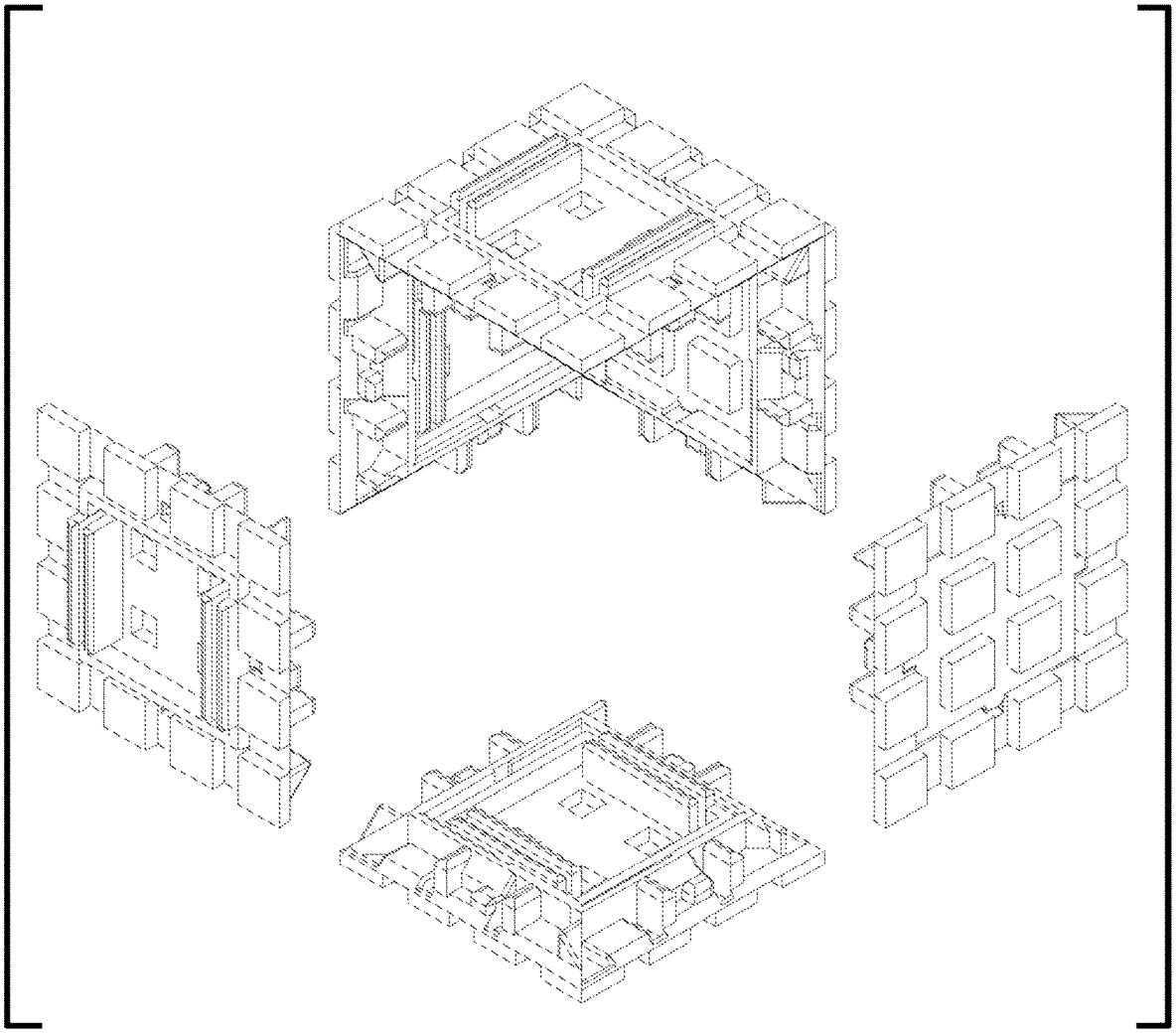
FIG. 87 shows an exploded view of a Byte in which three slide faces and three slide blocks are shown in exploded positions.

FIG. 86 shows an exploded view of a Byte in which one slide face and one slide block are shown in exploded positions.

FIG. 86 shows an exploded view of a Byte in which three slide faces and three slide blocks are shown in exploded positions.

While preferred and alternate embodiments have been illustrated and described, as noted above, many changes can be made without departing from the spirit and scope of the invention. Accordingly, the scope of the invention is not limited by the disclosure of these preferred and alternate embodiments. Instead, the scope of the invention should be determined entirely by reference to the claims. Insofar as the description above and the accompanying drawings disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶6. In particular, the use of "step of" in the claims herein is not intended to invoke the provisions of U.S.C. § 112 ¶6.

I claim:

1. The system of interconnecting blocks comprising:

a slide block having an inner face, an outer face, a plurality of edges, and a center hole, said outer face having a female interconnection channel, said edges having an edge interconnection feature adapted to be connectable to edge interconnection feature of additional slide blocks, said center hole adapted to accept a slide face and being connectable to said slide face by a slide face connection features located at the periphery of said hole, said slide face adapted to fit within said center hole having a male face, a female face, an edge having slide face interconnection features adapted to mate to said slide face connection features of said slide block, said male face having a male interconnection feature, said slide block and said slide face being adapted to be mechanically coupleable through interconnection of said male interconnection feature and said female slide face connection feature, said outer face female interconnection channel being mechanically coupleable to said male interconnection feature.

2. The system of claim 1 wherein said slide block and said slide face are mechanically coupleable such that said slide face male face is coplanar with said slide block outer face.

3. The system of claim 1 wherein said slide block and said slide face are mechanically coupleable such that said slide face female face is coplanar with said slide block outer face.

4. The system of claim 1 wherein a plurality of said slide blocks are interconnected to form a cube.

5. The system of claim 1 further comprising:

a flat connector having an edge interconnection feature adapted to mate to said edge interconnection feature of said slide block edges.

6. The system of claim 5 wherein a plurality of said slide blocks and at least one flat connector are interconnected to form a generally planar assembly.

7. The system of claim 1 further comprising:

a Bit of generally cubic shape and having male connecting feature adapted to be mechanically coupleable to said female interconnection channel.

8. The system of claim 7 wherein said Bit is comprised of an X Half-Bit and a Y Half-Bit.

* * * * *